US011774203B2

(12) United States Patent
Bennink

(10) Patent No.: US 11,774,203 B2
(45) Date of Patent: Oct. 3, 2023

(54) LINK FEED ASSEMBLY WITH LINKS

(71) Applicant: Andrew Bennink, Louisburg, KS (US)

(72) Inventor: Andrew Bennink, Louisburg, KS (US)

( * ) Notice: Subject to any disclaimer, the term of this patent is extended or adjusted under 35 U.S.C. 154(b) by 0 days.

(21) Appl. No.: 17/473,193

(22) Filed: Sep. 13, 2021

(65) Prior Publication Data

US 2022/0107151 A1 Apr. 7, 2022

Related U.S. Application Data

(63) Continuation of application No. 17/463,437, filed on Aug. 31, 2021, which is a continuation of application No. 16/797,349, filed on Feb. 21, 2020, now Pat. No. 11,137,226.

(60) Provisional application No. 62/808,483, filed on Feb. 21, 2019.

(51) Int. Cl.

| | |
|---|---|
| ***F41A 9/32*** | (2006.01) |
| ***F42B 39/08*** | (2006.01) |
| ***F41A 21/10*** | (2006.01) |
| ***F41A 11/00*** | (2006.01) |
| ***F41A 3/66*** | (2006.01) |
| *F41A 21/48* | (2006.01) |

(52) U.S. Cl.

CPC ..... *F41A 21/10* (2013.01); *F41A 3/66* (2013.01); *F41A 9/32* (2013.01); *F41A 11/00* (2013.01); *F42B 39/08* (2013.01); *F41A 21/485* (2013.01)

(58) Field of Classification Search

CPC ..... F41A 9/29; F41A 9/30; F41A 9/31; F41A 9/32; F41A 9/33; F42B 39/08

See application file for complete search history.

(56) References Cited

U.S. PATENT DOCUMENTS

| | | | | |
|---|---|---|---|---|
| 2,022,685 A | | 12/1935 | Moore | |
| 2,027,893 A | * | 1/1936 | Williams | F41A 9/32 89/33.2 |
| 2,327,922 A | | 8/1943 | Moore | |
| 2,345,340 A | * | 3/1944 | Howe | F42B 39/08 89/35.01 |
| 2,372,462 A | | 3/1945 | Webb | |
| 2,391,888 A | | 1/1946 | Elliott | |
| 2,417,080 A | * | 3/1947 | Lochhead | F41A 9/32 89/33.2 |
| 2,453,977 A | | 11/1948 | Eames | |
| 2,466,564 A | * | 4/1949 | Stephenson | F41A 9/32 74/98 |
| 2,481,726 A | | 9/1949 | D'Assis-Fonseca | |

(Continued)

*Primary Examiner* — Gabriel J. Klein

(74) *Attorney, Agent, or Firm* — Jason P. Webb; Pearson Butler

(57) ABSTRACT

A link feed assembly. There is: a bolt carrier near a chamber of a modular weapon system; an infeed ramp, coupled to a first side of a weapon frame near the chamber; an outfeed ramp, coupled to a second side of the capon frame near the chamber and opposite the infeed ramp, positioned to form a space between the infeed ramp and the outfeed ramp; and a feed arm assembly coupled to the weapon frame and extending over the space between the infeed ramp and the outfeed ramp, the feed arm assembly functionally coupled to the bolt carrier such that cycling of the bolt carrier forward and backwards causes cycling of the feed arm assembly in a circuitous motion, the feed arm including a grabbing protrusion that is shaped to grab a top portion of a link during cycling of the feed arm assembly.

20 Claims, 9 Drawing Sheets

(56) References Cited

U.S. PATENT DOCUMENTS

| | | | | |
|---|---|---|---|---|
| 2,809,563 | A | 10/1957 | Hammer | |
| 2,821,886 | A * | 2/1958 | Friend | F41A 9/33 89/33.2 |
| 2,899,865 | A * | 8/1959 | Colby | F41A 9/32 89/33.2 |
| 3,386,336 | A * | 6/1968 | Roy | F41A 3/72 89/185 |
| 3,987,701 | A | 10/1976 | Stephenson | |
| 4,587,879 | A | 5/1986 | Savioli | |
| 6,622,606 | B1 | 9/2003 | Neal | |
| 9,470,496 | B2 | 10/2016 | Kokinis et al. | |
| 2016/0195350 | A1 | 7/2016 | Packard et al. | |
| 2016/0305725 | A1 | 10/2016 | Patel | |
| 2018/0003452 | A1 * | 1/2018 | Polston | F41A 9/29 |

* cited by examiner

LINK FEED ASSEMBLY WITH LINKS

CROSS-REFERENCE TO RELATED APPLICATIONS

This ins anion claims priority under 35 U.S.C. § 120, to the U.S. Continuation patent application Ser. No. 17/463,437, Andrew Bent ink, filed on Aug. 31, 2021, which is incorporated by reference herein in its entirety, which claims priority to the U.S. Non-Provisional patent application Ser. No. 16/797,349 Andrew Bennink, filed on Feb. 21, 2020, which is incorporated by reference herein in its entirety, and thereby claims priority to the U.S. Provisional Patent Application No. 62/808,483, Andrew Bennink, filed on Feb. 21, 2019, which is incorporated by reference herein in its entirety.

BACKGROUND OF THE INVENTION

Field of the Invention

The present invention relates to ammunition and feed assemblies, specifically to modular multi-caliber and/or gauge feed assemblies and links for machine guns, belt fed rifles, belt fed shotguns, belt fed firearms.

Description of the Related Art

In the related art, it has been known to use modular multi-caliber and/or gauge machine guns, belt fed rifles, belt fed shotguns, belt fed firearms. Semi-automatic and/or fully-automatic firearms may be designed to automatically expel the spent casing and/or hull of a fired round of ammunition and chamber a new round of ammunition without the intervention of an operator. Such self-feeding of ammunition to a firearm is used to provide high rates of fire with fully-automatic firearms or provide quicker follow up shots and/or allow longer times between reloading. The self-feeding operation may be performed by the internal operating(s) group of the firearm using a variety of mechanism. A firearm may use the expanding gas from the fired round and/or the recoil from the fired round to provide energy to feed a new round of ammunition into the firearm and/or the firearm's chamber.

In a closed-bolt firearm, a cycle of the firearm may include moving a firing pin to detonate a round in a chamber, retracting, a bolt from the chamber, removing the casing of the fired round from the chamber, ejecting the casing and/or hull of the fired round from the firearm, advancing a new round into alignment with the chamber, chambering the new round and closing securing the boil to chamber and the round. In an open-bolt firearm, a cycle of the firearm may include moving a bolt and firing pin forward, striking a round of ammunition, moving the bolt away from the chamber, removing the casing of the fired round from the chamber, ejecting the casing of the fired round from the firearm, and advancing a new round into alignment with the chamber. In both closed bolt and open-bolt firearms, a cycle of the firearm includes advancing the next round into alignment with the chamber.

A feed ramp may be a precision machined piece of metal, or may be comprised of metal, plastic, or other materials, in a breech-loading firearm that guides a cartridge and/or shot shells/shotgun shells at the top of the magazine and/or cartridges and/or shot shells'shotgun shells stripped from links into the firing chamber. The feed ramp can be part of the receiver assembly of a semi-automatic and/or fully automatic rifle, shotgun, pistol or firearm. After the rifle, shotgun, pistol or firearm, is fired and the spent cartridge and/or hull is ejected, a fresh cartridge and/or shot shell/shotgun shell slides forwards and upwards along the feed ramp from the magazine and/or cartridge and or shot shell/shotgun shell stripped from links into firing position.

Some improvements have been made in the field. Examples of references related to the present invention are described below in their own words, and the supporting teachings of each reference are incorporated by reference herein:

U.S. Pat. No. 2,453,977, issued to J. O. Eames, discloses in an automatic gun adapted to fire cartridges carried to the gun by gripping links comprising a flexible belt, the combination comprising a feedway for the belt, said feedway having a slot defined by edges in said feedway for engagement with a portion of each link, means for feeding the belt in a step-by-step movement to position each link and its gripped cartridge in alignment with said slot, and means for moving said link into interlocked relation with the edges of said slot and maintaining said relation during stripping of the cartridge from the ink for chambering thereof said last mentioned means including a members carried by, and slide able with respect to said feeding means and having a cam surface for engagement with the link whereby to force said link to slot edge-engaging position.

U.S. Pat. No. 2,466,564, issued to J. R. Stephenson, discloses in a belt feed mechanism for a rapid fire gun, a first element constituting a support for said mechanism, said support including a mounting pin, a second element constituting a belt feed level base carried by said pin, said base having a slot provided in the one face thereof, a key within said slot having one edge arranged at an angle to the opposite edge thereof, one of said edges being disposed in said slot and the other of said edges being disposed against said support, said key and one of said elements having interlocking lugs for holding said key against movement lengthwise of said slot.

U.S. Pat. No. 3,987,701, issued to Tschui et at, discloses an ammunition conveyor channel for use with an automatic firing weapon and through which channel there can be conveyed belted ammunition to the weapon, comprising an inlet opening through which there can be introduced the ammunition into the ammunition conveyor channel, a first outlet opening, through which there can be ejected the ammunition and inserted into the weapon barrel, and a second out let opening through which there can be ejected the belt elements of the ammunition belt out of the ammunition conveyor channel. The second outlet opening is arranged in a cover member extending transversely with respect to the conveying direction of the ammunition, this cover member being mounted to be pivotable about a pivot shaft arranged externally of the cross-sectional area of the channel so as to be pivoted into an open position enabling removal of the ammunition introduced through the inlet opening and not ejected through the first outlet opening.

U.S. Pat. No. 4,587,879, issued to Savioli, discloses in a weapon system including a gun barrel and a bolt carrier, a cartridge feeder system comprises sprockets for stripping cartridges individually from a cartridge belt, and moving the cartridges in an upward direction against guide ramps for positioning the cartridge on a pedestal support having a profile for holding the cartridge in vertical angular alignment between the chamber of the barrel and a bolt lug of the bolt of the bolt carrier, thereby permitting larger cartridges to be fed to the barrel in the space between the open bolt and the chamber, which space can accommodate only smaller caliber cartridges in the horizontal distance therebetween, whereby as the bolt moves the cartridge into the chamber, the angular positioning of the cartridge is changed via the profile of the pedestal support, permitting safe entry of the cartridge into the chamber.

U.S. Patent Application Publication No. 2016/0195350, by Packard et al., discloses a firearm assembly includes an upper receiver assembly having a front face and an aperture formed through the front face, and a feed ramp insert member removably coupled to the upper receiver assembly. The feed ramp insert member has a profile matching at least a portion of the aperture. The feed ramp insert member extends outwardly from the front face of the upper receiver assembly adjacent to the aperture. The feed ramp insert member is operative to interfere with incidental contact between a cartridge and at least a portion of the upper receiver assembly.

The inventions heretofore known suffer from a number of disadvantages which include: not allowing one to change out ammunition cartridges and/or shot shells/shotgun shells for varying needs, not allowing one to change out cartridges or shot shells/shotgun shells to be used in one firearm/receiver, not allowing for belt-fed weapon systems of calibers or shot shells/shotgun shells not currently available, requiring more types of links to supply a fighting force, requiring more belt-fed firearms or versions to achieve the versatility and/or uses of this system, not keeping one in a firelight longer because one cannot reuse links during the fight, being less reliable, not being reusable, not allowing for belt-fed shotguns, weapon hardware not working with existing disintegrating links, and allowing for less variety of an munition and/or cartridges and/or shot shells/shotgun shells, not allowing for a hybrid links system between single construction belts and disintegrating links, not allowing in the field changing between chamberings with the same receiver.

What is needed is a feed assembly and feed links that solves one or more of the problems described herein and/or one or more problems that may come to the attention of one skilled in the art upon becoming familiar with this specification.

SUMMARY OF THE INVENTION

The present invention has been developed in response to the present state of the art, and in particular, n response to the problems and needs in the art that have not yet been fully solved by currently available feed assemblies and links or by currently available belt fed rifles, belt fed shotguns, and/or belt fed firearms. Accordingly, the present invention has been developed to provide a link feed assembly and a new style of links for supplying cartridges and/or shot shells/shotgun shells to a weapon system.

The link feed assembly may comprise: a bolt carrier that may be near a chamber of a weapon system; an infeed ramp, that may be coupled to a first side of a weapon frame near the chamber; an outfeed ramp, that may be coupled to a second side of the weapon frame near the chamber and/or opposite the infeed ramp, that may be positioned to form a space between the ideal ramp and/or the outfeed ramp through which cartridges and/or shot shells/shotgun shells may fall and/or be in able situated into position to be chambered into firing position in the chamber; a feed arm and or a feed arm assembly that may be coupled to the weapon frame and/or extending over the space between the infeed ramp and or the outfeed ramp, the feed arm and/or the feed arm assembly may be functionally coupled to the bolt carrier such that cycling of the bolt carrier forward and/or backwards may cause cycling of the feed arm and/or the feed arm assembly in a circuitous, and/or a rotating horizontal motion, the feed arm and/or feed arm assembly may include a grabbing protrusion that pray be shaped to grab a top portion (by dropping downwards and/or a horizontal motion) of a link during cycling of the feed arm and/or feed arm assembly drags the link across the space between the infeed ramp and/or the outfeed ramp and/or then rise upwards and/or slip over the top of a link and/or travel back across the space.

In other embodiments, the link feed assembly may further comprise a plurality of links. Each link may be releasably and/or temporarily coupled to the infeed ramp and/or the outfeed ramp. The link feed assembly may also comprise a chamber holder that may be disposed about the chamber. The feed arm and/or feed arm assembly may be removably and/or hingedly and/or temporally and/or spring held coupled to the chamber holder. The infeed ramp may include a protrusion that may be coupled to the infeed ramp and/or extending outwardly therefrom, and/or removably and/or slidably coupled to the links. The protrusion may be pyramid-shaped. The link assist, may be tongue-shaped.

In yet additional embodiments, the plurality of links may be non-disintegrating and/or reusable and/or a hybrid between the one piece solid constructed belts and the disintegrating links. The feed arm and/or feed arm assembly may be coupled to the chamber holder by a pin. Each link of the plurality of links may be pivotally coupled to another link by but not limited to a spring-loaded pin; and/or each link may have a right side and/or a left side where a groove may be disposed along a top of the right side of each link (for right-handed versions, left-handed versions may be a mirrored image of the right-handed version i.e. the groove for left-handed versions may be located on the left side link), the groove removably coupled to a tab of the feed arm and/or feed arm assembly. A first link of the plurality of links may include a link assist that is coupled to the first link, wherein the link assist is tapered along a front portion. The infeed ramp may include a ridge disposed along a top portion of the ramp which may be disposed beneath a cartridge and/or shot shells/shotgun shells. The link feed assembly may also include a knob that may be disposed along a top of the chamber holder, and/or a feed cover that may be disposed over the feed arm and/or feed arm assembly. The feed cover may include a dimple that mates with the knob and/or a point on the knob. The feed cover may be hingedly, coupled to the firearm.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art ill recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
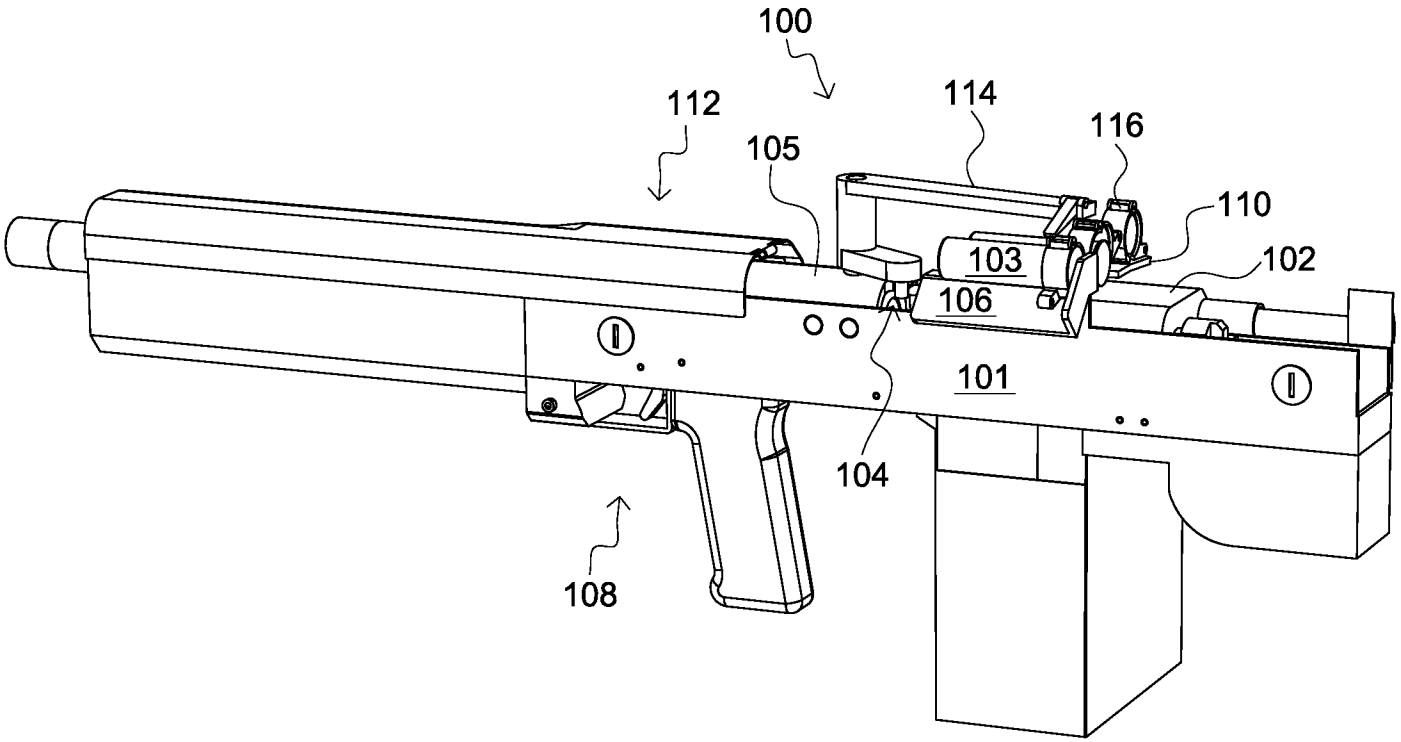
FIG. 1 is a partial first side perspective view of a modular multi-caliber and/or gauge weapon system with a feed cover removed showing a feed assembly and links, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to art "embodiment" an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc, does not mean that the features are necessarily related, dissimilar, the same, etc.

Each statement of an embodiment, or example, is to be considered independent of any other statement of an embodiment despite any use of similar or identical language characterizing, each embodiment. Therefore, where one embodiment is identified as "another embodiment," the identified embodiment is independent of any other embodiments characterized by the language "another embodiment". The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a partial first side perspective view of a modular multi-caliber and/or gauge weapon system with a feed assembly cover removed showing a feed assembly and links, according to one embodiment of the invention. There is shown a link feed assembly 100 with a weapon frame 101. A bolt carrier 102 is slidably coupled to the weapon frame 101. A chamber 104 is also disposed within a chamber holder 105 and is coupled to the weapon frame 101. The chamber 104 is also functionally coupled to the bolt carrier/bolt face 102. A chamber holder 105 is disposed about the chamber 104. There is also an infeed ramp 106 coupled to a first side 108 of the weapon frame 101, and an outfeed ramp 110 coupled to a second side 112 of the weapon frame 101 opposite the infeed ramp 106. A feed arm assembly 114 is coupled to the chamber holder 105 and extends upwardly therefrom. A link 116 may be removably coupled to the feed arm assembly 114 and slidably disposed along the inked ramp 106 and the outfeed ramp 110.

As shown, the feed assembly 100 includes an inked ramp 106 coupled to a posterior portion of the weapon frame 101. The illustrated link feed assembly 100 includes the bolt carrier 102 disposed near the chamber holder 105 and chamber 104. The infeed ramp 106 is coupled to the first side 108 of the weapon frame 101 near the chamber 104. M one embodiment, the infeed ramp 106 may be fixedly coupled to the weapon frame 101. As illustrated, the infeed ramp 106 may be sloped upward or at an incline. In one embodiment, the infeed ramp 106 may be flat or non-sloped, in another embodiment, the infeed ramp may have a flat or non-sloped portion or section.

The infeed ramp 106 functions to direct a fresh or live cartridge and/or shot shell/shotgun shell 103, from links 116 into firing position aligned with the chamber 104. Advantageously, the infeed ramp 106 helps the feed arm assembly 114 guide the links 116 with cartridges and/or shot shells/shotgun shells 103. The infeed ramp 106 allows the feed arm assembly 114 to pull the links 116 with cartridges and/or shot shells/shotgun shells 103 across the infeed ramp 106 and guides cartridges and/or shot shells/shotgun shells 103 into the path of the bolt/bolt carrier 102 to align with the chamber 104. The infeed ramp 106 may be comprised of metal, plastic, or other materials. In one embodiment, the infeed ramp 106 may be a tightly machined and polished piece of metal.

In addition, the infeed ramp 106 may have any length, width, incline, coefficient of friction, etc, for feeding, guiding and/or allowing pulling the links 116.

Also, as used herein, the term "cartridge" is used interchangeably with shot shells and shotgun shells. While it is understood that cartridges, shot shells and shotgun shells are different types of ammunition, in this instance, the term "cartridge" may refer to any type of ammunition, projectile, etc. that may be utilized by the feed arm assembly 114. Moreover, it is understood that as "cartridge" is used herein, maybe defined to include but is not limited to plastic cased ammunition, caseless ammunition, telescoping ammunition, cartridges, shot shells/shotgun shells and/or any other means of a projectile being held, and/or accelerated.

The illustrated outfeed ramp 110 is also coupled to a posterior portion of the weapon frame 101. As shown, the outfeed ramp 110 is a right-handed version. In one embodiment, a left-handed version would be a mirror-image of the right-handed version. As shown, the outfeed ramp 110 is coupled to a second side of the weapon, frame 101 near the chamber 104 and opposite the infeed ramp 106. In one embodiment, the outfeed ramp 130 may be fixedly coupled to the weapon frame 101. The outfeed ramp 110 may be sloped downward or decline. In one embodiment, the outfeed ramp 110 may be flat or non-sloped. In another embodiment, the outfeed ramp 110 may have a flat section or portion. The outfeed ramp 110 allows empty links 116 without cartridges and or shot shells/shotgun shells 103 to exit the weapon frame 101. Accordingly, the feed arm assembly 114 may pull empty links 106 across the outfeed ramp 110. The outfeed ramp 110 functions to keep the empty and used links 116 out of the way and allows the links 116 to exit the weapon frame 101. Similar to the in feed ramp 106, the outfeed ramp 110 may be comprised of metal, plastic, or other materials and/or as have any length, width, decline, coefficient of friction, etc.

The feed arm assembly 114 is illustrated as coupled to the weapon frame 101 and extending between the infeed ramp 106 and the outfeed ramp 110. The feed arm assembly 114 is functionally coupled to the bolt carrier 102 such that cycling of the bolt carrier 102 forward and backwards causes cycling of the feed arm assembly 114 in a circuitous motion. The feed arm assembly 114 may cycle in a circuitous motion such that in one cycle, the feed arm assembly 114 moves away from a starting point and returns to the starting point. In one embodiment, the feed arm assembly 114 may cycle by dropping downwards and or rotating in a horizontal motion, and then cycling back to where the feed arm assembly 114 started from. A cycle of the feed arm assembly 114 may not be circular. The feed arm assembly 114 toggles, or switches features, when the bolt carrier 102 moves forward, thereby drawing links 116 across the feed ramps 106 and 110. For instance, in one embodiment, such as a right-handed version of the assembly 114, the feed arm assembly 114 may move to the first side, or a right side, 108 when the bolt carrier 102 is rearward, and then move to the second side, or left side, 112 of the frame 101 when the bolt carrier 102 is against the chamber 105. Accordingly, an embodiment of a left-handed version of the assembly 114 may be a mirror-image of the right-handed version.

In one embodiment, the feed arm assembly 114 may be coupled to the chamber holder 105. The chamber holder 105 is disposed about the chamber 104 and the feed arm assembly 114 is removably and/or hingedly and/or functionally coupled to the chamber holder 105. For example, in one non-limiting embodiment, the tied arm assembly 114 may be coupled to the chamber holder 105 by a pin that may drop into the chamber holder 105. The feed arm 114 may be comprised of any material, such as but not limited to, metal, plastic, and other materials. In addition, it is envisioned that the feed arm assembly 114 may be spring loaded to provide horizontal movement that may be ammunition-specific. The spring may rest against the frame 101 of a firearm and may be a part of the feed arm assembly 114 and/or may be independently removable.

The illustrated links 116 are releasably coupled to the infeed ramp 106 and the outfeed ramp 110. The links 116 are releasably coupled to the ramps 106 and 110 so that the links 116 may be coupled to and uncoupled from the ramps 106 and 110. For instance, the links 116 may rest and/or slide along the ramps 106 and 110. The links 116 may be dependent upon the cartridge and/or shot shells/shotgun shells chosen and may thereby be sized and/or shaped to hold any caliber of cartridge 103 and/or shot shell/shotgun shell. The links 116 may be any link 116 of any size for loading with ammunition and providing ammunition to a weapon. The links 116 may be sized and/or shaped depending upon the ammunition chosen, or for magazines depending upon the size of the ammunition and/or depending on the size of a box magazine opening. The links 116 may be disintegrating or non-disintegrating. In one non-limiting embodiment, the links 116 are non-disintegrating links 116. In another non-limiting embodiment, the links 116 may be a hybrid between single piece constructed ammunition belts and disintegrating links. The links 116 may be pivotally coupled to each other. For instance, in one embodiment the links may be pivotally coupled to each other by pins, such as but not limited to spring-loaded pins. Importantly, the links 116 may easily be reloaded in the field. The links 116 may be comprised of a variety of materials, such as but not limited to steel, aluminum, and/or plastic.

In operation of one embodiment of the link feed assembly, cartridges and/or shot shells/shotgun shells are loaded into a plurality of links. The links travel up an infeed ramp coupled to a weapon frame. The links are removably coupled to a feed arm. The feed arm assembly is coupled to a chamber holder and functionally coupled to a bolt, each also being functionally coupled to the weapon frame. As the bolt cycles, the feed arm assembly releasably couples to the links. The feed arm assembly couples to a first link and draws the link across a space from the infeed ramp to an outfeed ramp. The feed arm assembly may couple to a groove disposed along the link. As the link is drawn across the space by the feed arm assembly, the link is pivotally opened and the cartridge and/or shot siren/shotgun shell drops into the space and is loaded into the chamber by the bolt. The link then travels down the outfeed ramp and the feed arm assembly travels back to the infeed ramp to grab the next link. The first link may have a link assist that may initially couple to the feed arm assembly and align the links with the infeed/outfeed ramps to clear the space or gap between both ramps. Beneficially, the link feed assembly allows different cartridges and/or shot shells/shotgun shells to be used in the same firearm. The link feed assembly helps guide a cartridge from a box magazine (if the magazine is a box magazine that contains the links) or ammunition belt to be chambered, regardless of diameter or overall length.

In another non-limiting embodiment, the links may couple to any size of cartridge and/or shot shell/shotgun shell to allow one to fire any cartridge and/or shot shell/shotgun shell that fits dimensions of the chamber and/or does not exceed the overall length of the chamber. The links stay together instead of disintegrating so that one can load the links faster, and so that the links are reusable, even in the field without the need of tools. The feed arm assembly toggles when the bolt carrier goes forward and backwards, which then draws the links across. The feed arm assembly may slide over a knob on the chamber holder which rests against the top of a feed cover. In one embodiment, the feed arm assembly raises up and grabs link after link as it pivots back and forth while the weapon cycles. The links may be pinned together or may have a quick thread bolt to be bolted together, and pivot open and shut as they cycle through the weapon. As the bolt-face travels rear ward, a link pivots open, and a loose shell/cartridge drops into place. A point on the infeed ramp helps spread the link open as it is getting drug across. The outfeed ramp is higher and out of the way so that the links are kept out of the path of the bolt carrier and bolt face to prevent the links from jamming the weapon. The links may be separated by rotating and periling out a pin (or a bolt but not limited to a pin or bolt) that may hold adjacent links together. The links may include a link assist that may be tongue shaped and/or rounded at the end and widen. The link assist may allow the feed arm assembly to pull the first link into place by drawing it across the ramps, or it may be drawn across the ramps by hand. The link assist may couple to a first link with a pin or quick threaded bolt, such as but not limited to a spring-loaded pin.

Figure 2:
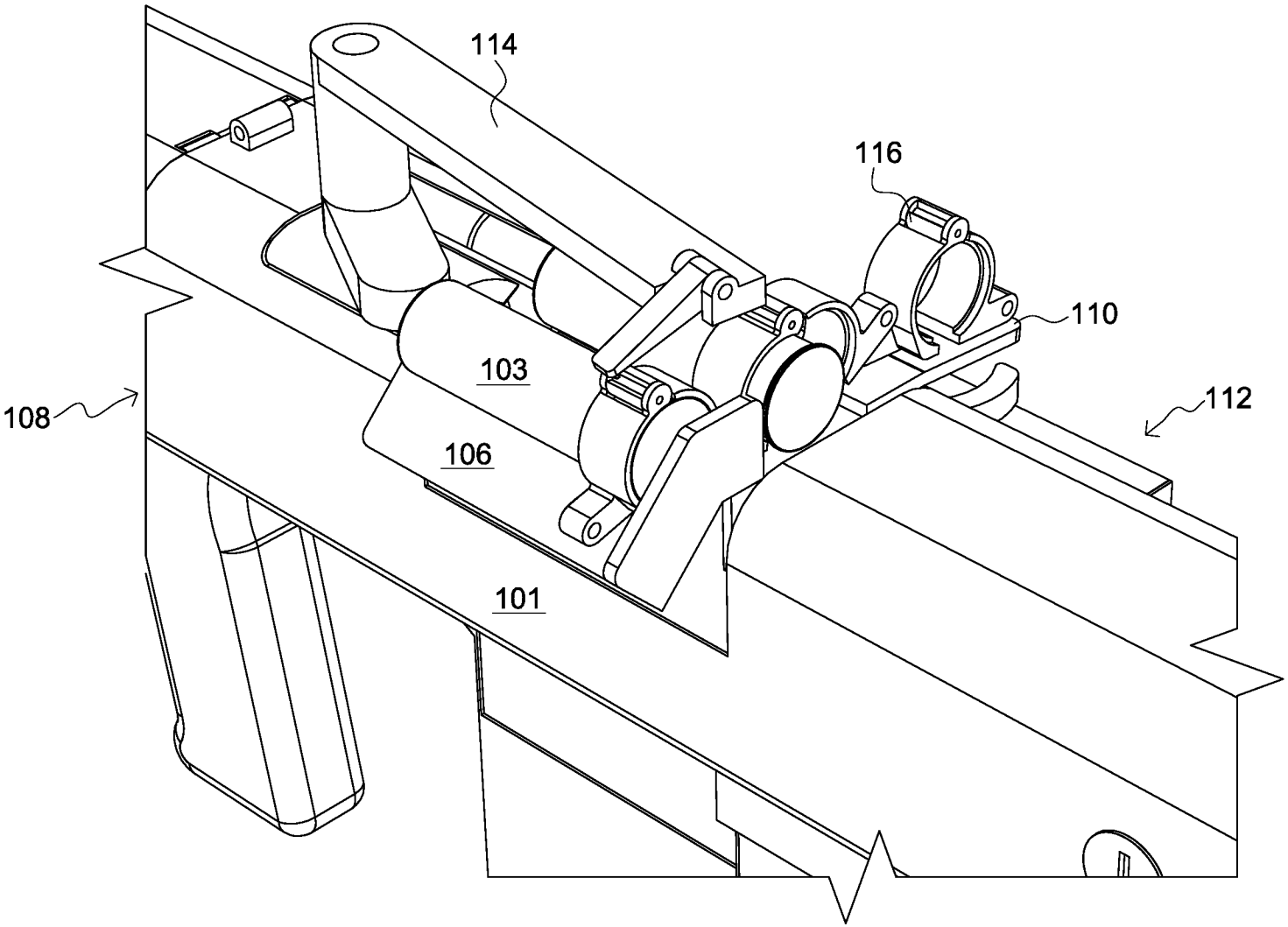
FIG. 2 is a partial first side perspective view of a modular multi-caliber and/or gauge weapon system with a feed cover removed showing a feed assembly and links, according to one embodiment of the invention.

FIG. 2 is a partial first side perspective view of a modular multi-caliber and/or gauge weapon system with a feed cover removed showing a feed assembly and links, according to one embodiment of the invention. As shown, there is a weapon frame 101. The weapon frame has a first side 108 and a second side 112. An infeed ramp 106 is coupled to the first side 108, and an outfeed ramp 110 is coupled to the second side 112. Disposed along the ramps 106 and 110 are a plurality of links 116. The links 116 are coupled to cartridges and/or shot shells/shotgun shells 103. A feed arm assembly 114 is also coupled to the weapon frame 101 and extends upwardly therefrom. The feed arm assembly 114 is removably coupleable to the links 116.

The illustrated feed arm assembly 114 may be but not limited to being pivotally, or hingedly, coupled to the weapon frame 101. The feed arm assembly 114 removably couples to the links 116 containing cartridges and/or shot shells/shotgun shells 103. As the feed arm assembly 114 pivots, the feed arm assembly 114 couples to the links 116 and pulls the links 116 from the infeed ramp 106 to the outfeed ramp 110 across the weapon frame 101. The links 116 open as the links 116 are pulled across the infeed ramp 106 and release the cartridges and/or shot shells/shotgun shells 103 so that the cartridges and/or shot shells/shotgun shells 103 fall into the weapon frame 101 in the path of the bolt carrier 102 for chambering.

Figure 3:
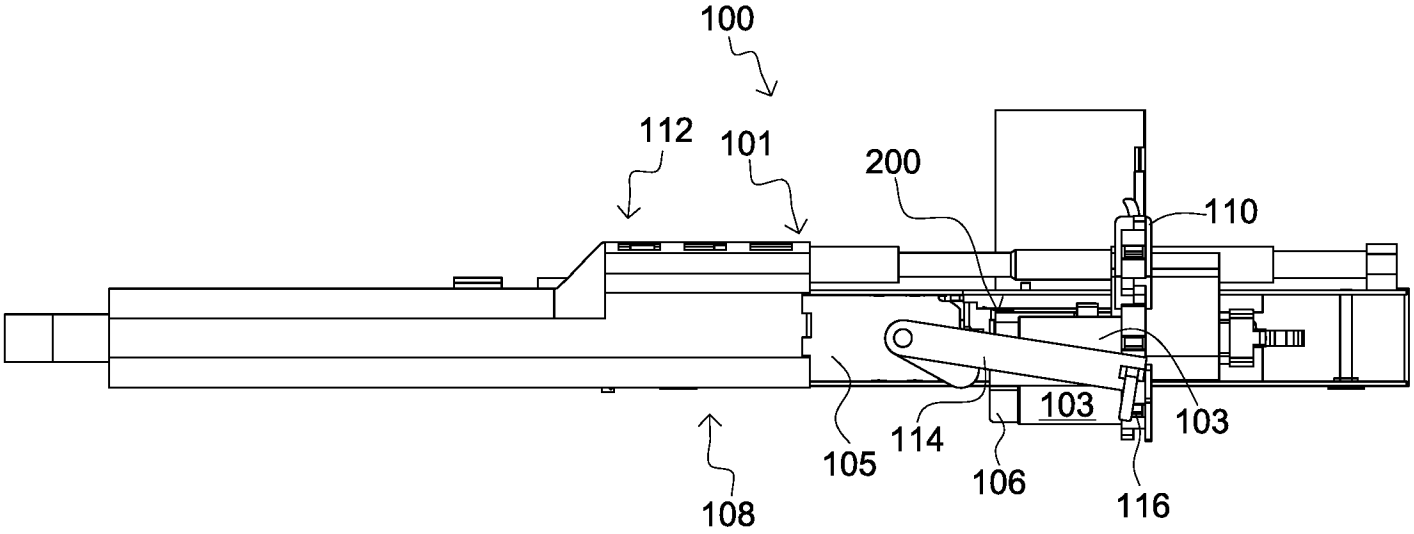
FIG. 3 is a top plan view of a modular multi-caliber and/or gauge weapon system with a feed cover removed showing a feed assembly and links, according to one embodiment of the invention.

FIG. 3 is a partial top plan view of a modular multi-caliber and/or gauge weapon system with a feed cover removed showing a feed assembly and links, according to one embodiment of the invention. There is illustrated link feed assembly 100 with a weapon frame 101. A bolt carrier 102 is slidably coupled to the weapon frame 101 and is functionally coupled to a chamber holder 105. A feed arm assembly 114 is coupled to the chamber holder 105 and extends upwardly therefrom. The weapon frame 101 includes a first side 108 and a second side 112. Coupled to the first side 108 of the weapon frame 101 is an infeed ramp 106, and coupled to the second side 112 of the weapon frame 101 is an outfeed ramp 110. A plurality of links 116 are slidably disposed along the ramp 106 and 110, and are removably coupled to the feed arm assembly 114. In one embodiment, a cartridge and/or shot shell/shotgun shell 103 is removably coupled to the links 116 and may be disposed in a space 200 between the infeed and outfeed ramps 106 and 110.

As shown, the outfeed ramp 106 is positioned to form a space 200 between the infeed ramp 106 and the outfeed ramp 110. Cartridges and/or shot shells/shotgun shells 103 may fall into the space 200 to be in a position to be chambered into firing position in the chamber (See e.g., item 104). The space 200 is disposed between the ramps 106 and 110. As links 116 are pulled from the infeed ramp 106 to the outfeed ramp 110 by the feed arm assembly, the links 116 are spread open and drop cartridges and/or shot shell/shotgun shell 103 into the space 200. Once a cartridge and/or shot shell/shotgun shell 116 is in the space 200, it may then be pushed into the chamber (See e.g., FIG. 1, Item 104) by the bolt carrier, and/or the bolt, face, 102 for firing. The space 200 may have any length, width, height for disposing a cartridge and/or shot shell/shotgun shell 103 within it.

The illustrated feed arm assembly 114 is coupled to the weapon frame 101 and extends over the space 200 between the infeed ramp 106 and the outfeed ramp 110. Also illustrated, the plurality of links 116 is selectively disposed along the infeed ramp 106 and the outfeed ramp 110. The feed arm assembly 114 couples to links 116 and pulls the links 116 across the space 200 from the infeed ramp 106 to the outfeed ramp 110. As the links 116 are pulled across the space 200, the links 116 pivot open and drop a cartridge and/or shot shell/shotgun shell 103 into the space 200. There may be a variety of feed arm assemblies 114 of different sizes and angles that couple to the weapon frame 101 to allow one to use different sized cartridges and/or shot shells/shotgun shells 103. In addition, it is envisioned that the feed arm assembly 114 may function with preexisting disintegrating links and/or single piece constructed belts by being able to interchange with other feed arm assemblies. In one embodiment, the feed arm assembly 114 may removably couple to single piece constructed links, disintegrating links, and/or links that are a hybrid of both single piece constructed belts and disintegrating links (as illustrated).

Figure 4:
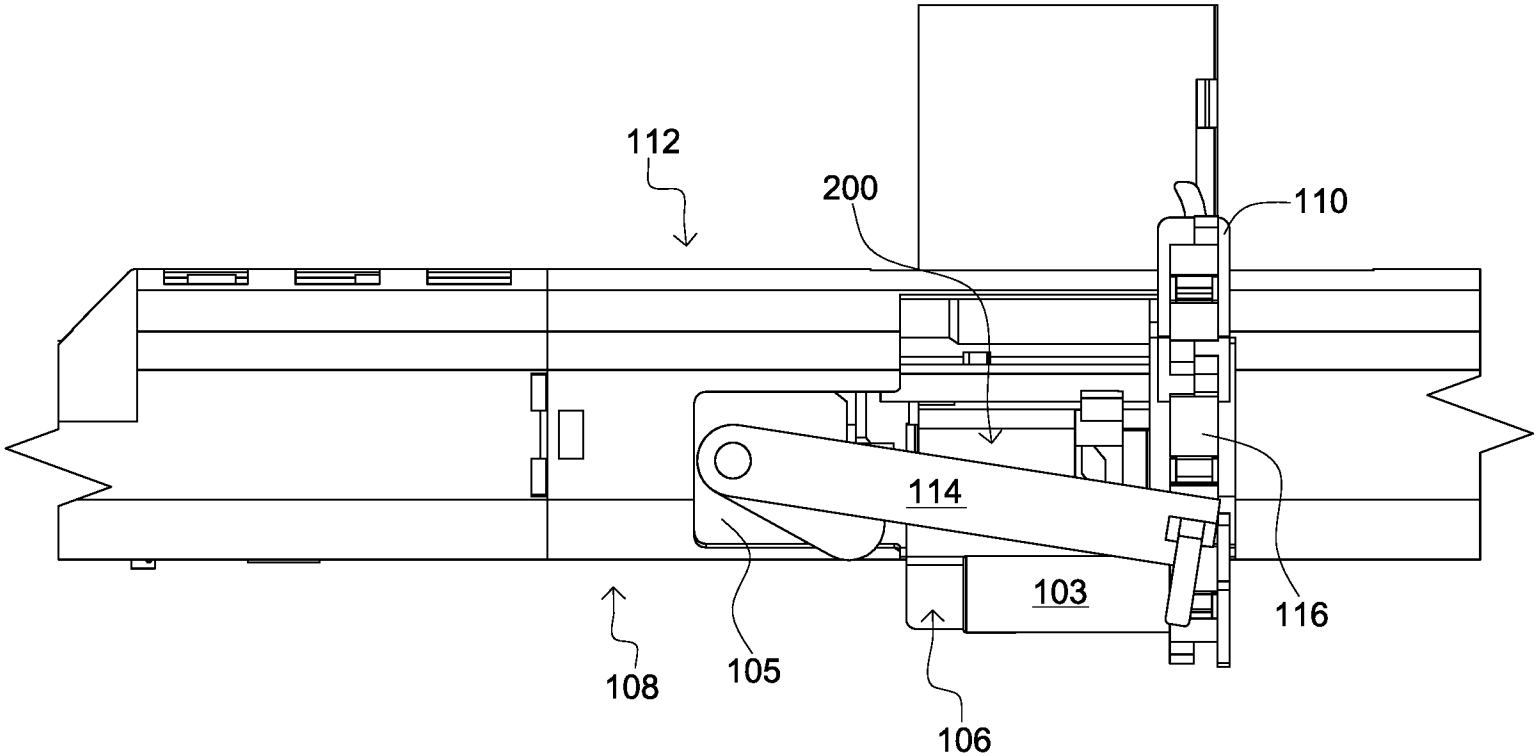
FIG. 4 is a partial top plan view of a modular multi-caliber and/or gauge weapon system with a feed cover removed showing a feed assembly and links, according to one embodiment of the invention.

FIG. 4 is a partial top plan view of a modular multi-caliber and/or gauge weapon system with a feed assembly cover removed showing a feed assembly and links, according to one embodiment of the invention. There is shown a feed assembly with a feed arm assembly 114. The feed arm assembly 114 is pivotally coupled to a chamber holder 105 and extends upwardly therefrom. The feed arm assembly 114 is removably coupleable to a plurality of links 116. In one embodiment, the links 116 are removably coupled to a cartridge and for shot shell/shotgun shell 103. An infeed ramp 106 is disposed along a first side 108 and an outfeed ramp 110 is disposed along a second side 112 with the feed am assembly 114 disposed therebetween. Also disposed between the infeed and outfeed ramps 106 and 110 is a space 200. The space 200 is disposed below the feed arm assembly 114 so that the cartridge and/or shot shell shotgun shell 103 may fall into the space 200 when the links 116 are pulled across the ramps 106 and 110 by the feed arm assembly 114 and opened.

As shown, there is a space 200 disposed between the infeed ramp 106 and the outfeed ramp 110. The space 200 is also disposed below the feed arm assembly 114. The space 200 may be an interior of the weapon. The space 200 may have any size or shape for allowing cartridges and/or shot shells/shotgun shells 103 to fall into the space 200 for chambering. In addition, it is envisioned that the cartridges and/or shot shells/shotgun shells 103 may rest on top of a box magazine's trough or in a trough that is inserted into a magazine well when using an ammunition belt independent of a box magazine.

Figure 5:
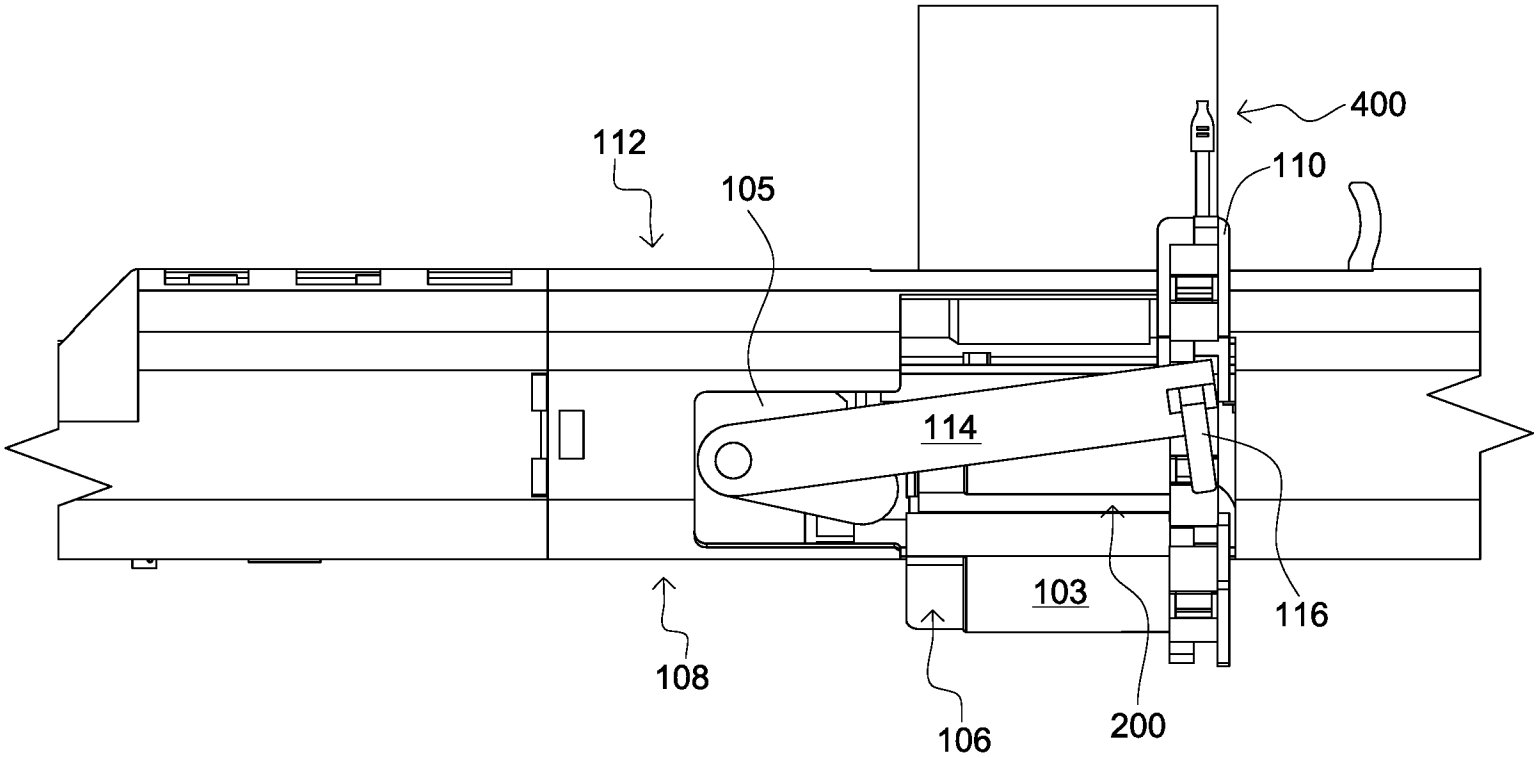
FIG. 5 is a partial top plan view of a modular multi-caliber and/or gauge weapon system with a feed cover removed showing a feed assembly and links, according to one embodiment of the invention.

FIG. 5 is a partial top plan view of a modular multi-caliber and/or gauge weapon system with a feed cover removed showing a feed assembly and links, according to one embodiment of the invention. There is illustrated a feed assembly with a feed arm assembly 114. The feed arm assembly 114 may be removably coupled to a chamber holder 105. The feed arm assembly 114 is removably coupled to a plurality of links 116. The plurality of links 116 may have a link assist 400 coupled to a first link 116 and may be removably coupleable to the feed arm assembly 114. The links 116 may also be removably coupled to a cartridge and/or shot shell/shotgun shell 103 and may travel along an infeed ramp 106 and an outfeed ramp 110. The outfeed ramp 110 may be disposed along a second side 112 opposite the infeed ramp 106 disposed along a first side 108 with a space 200 disposed therebetween. In one embodiment, the infeed ramp 106 may include a protrusion or ridge 300 disposed along a top portion of the infeed ramp 106. In another embodiment, the protrusion 300 may be disposed along an edge of the infeed ramp. In yet another embodiment, the infeed ramp 106 includes a protrusion or ridge 300 for supporting, opening, and/or guiding the cartridge and/or shot shell/shotgun shell 103 with links 116.

As illustrated, the infeed ramp 106 includes a protrusion or ridge 300 disposed along a top portion of the ramp 106. The protrusion 300 is coupled to the infeed ramp 106 and extends outwardly or upwardly therefrom. The protrusion 300 may be fixed to the infeed ramp 106. The protrusion 300 is removably and slidably coupled to the links 116. In one embodiment, the protrusion 300 may be a lip. The protrusion 300 may be pyramid-shaped so that it juts out. The protrusion or ridge 300 may be disposed adjacent to a link 116 prior to the cartridge and/or shot shell/shotgun shell 103 entering the chamber (See e.g., FIG. 1, Item 104). Accordingly, as the links 116 slide along, the infeed ramp 106 the protrusion 300 may spread open the links 116 thereby releasing a cartridge and/or shot shell/shotgun shell 103 into the space 200.

As shown, the plurality of links 116 includes a link assist 800. In one embodiment, the link assist 400 is coupled to a first link 400 and extends outwardly therefrom. In one embodiment, the link assist 400 may be tapered along a front portion and may have a full width along a back portion. In one embodiment, the link assist 400 may be tongue-shaped. The link assist 400 may couple to an end of the first link 400 by a pin and/or a quick threaded bolt, such as but not limited to a spring-loaded pin. The link assist 400 properly aligns the links 116 with the feed arm assembly 114 to allow the feed arm assembly 114 to grab and pull the links 116 across the ramps 106 and 110. Accordingly, the link assist 400 may be a tab that may be added to a first link 116 to align the links 116 to be in a proper position with the feed arm assembly 114 and/or to be pulled through by hand. Additionally, in one embodiment, cycling the action causes the feed arm assembly 114 to act upon the link assist 400 to properly position the links 116. The link assist 400 may be comprised of a variety of materials similar to the links 116, such as but not limited to: steel, aluminum and/or plastic.

Figure 6:
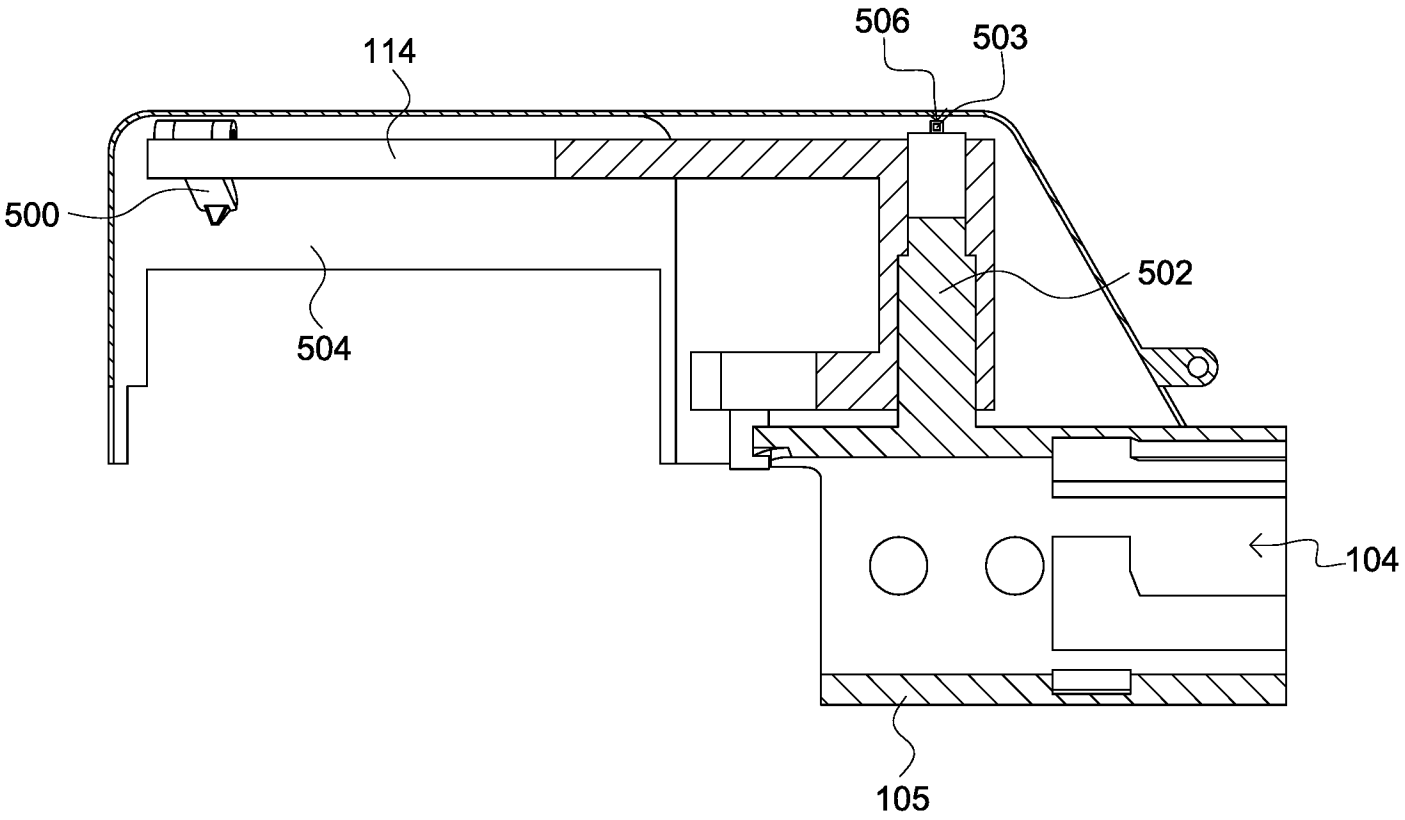
FIG. 6 is a partial sectional second side elevational view of a modular multi-caliber and/or gauge weapon system showing a feed and/or feed arm assembly, according to one embodiment of the invention.

FIG. 6 is a partial sectional second side elevational view of a modular multi-caliber and/or gauge weapon system showing a feed arm assembly, according to one embodiment of the invention. There is shown a feed arm assembly 114 with a grabbing protrusion 500. The feed arm assembly 114 is coupled to a chamber holder 105. A chamber 104 is disposed within the chamber holder 105. The chamber holder 105 includes a knob 502 that is coupled to the chamber holder 105 and extends upwardly therefrom. The knob 502 includes a point 503 that extends upwardly from the knob 502. The point 503 may mate with a dimple 506 disposed along an underside of a feed cover 504. The feed cover 504 is disposed over the feed arm assembly 114.

As illustrated, the feed arm assembly 114 has a grabbing protrusion 500. The grabbing protrusion 500 is shaped to grab a top portion of a link (See e.g., FIG. 5, Item 116) during cycling of the feed aim assembly 114 and drag the link (See e.g., FIG. 5, Item 116) across the space (See e.g., FIG. 5 item 200) between the infeed ramp and the outfeed ramp (See e.g., FIG. 5. Items 106 and 110, respectively) and then rise upwards. In one embodiment, the grabbing protrusion 500 may be the only portion that rises upward, while the majority of the feed arm assembly 114 stays put. The grabbing protrusion 500 may be hinged and/or under spring tension. The grabbing protrusion 500 may have any size and/or shape for snagging the links (See e.g., FIG. 5, item 116) and pulling them across the space (See e.g., FIG. 5, Item 200). The grabbing protrusion 500 shape and/or size may depend upon a cartridge and/or shot shell/shotgun shell being used (See e.g., FIG. 1, Item 103). In one embodiment, the grabbing protrusion 500 may be pointed. In another embodiment, the grabbing protrusion 500 may be such as a hook. The grabbing protrusion may be comprised of a variety of materials such as but not limited to metal or plastic.

Also shown, a knob 502 is disposed along a top of the chamber holder 105. The knob 502 extends upwardly from the chamber holder 105. In one embodiment, the knob 502 may be an extension such as a handle. In another embodiment, the knob 502 may be a one-piece construction with the chamber holder 105 or may be made up of multiple pieces. For instance, in one non-limiting embodiment, the knob 502 may thread into the chamber holder 105.

As shown, the knob 502 includes a point 503 that extends upwardly therefrom. The point 503 extends upwardly from the knob 502 to mate the knob 502 with the feed cover 504. The knob 502 may have any size and/or shape for mating the knob 502 with the feed cover 504. The point 503 may be tapered, rounded, flat, and so on.

The feed arm assembly 114 is coupled to the knob 502. In one embodiment, the feed arm assembly 114 is removably coupled to the knob 502. For instance, the feed arm assembly 114 may be removably coupled to the knob 502 by tension fit or force, such as gravity. In one, no limiting embodiment, the feed arm assembly 114 may be removably coupled to the knob 502 by a pin, such as but not limited to a spring-loaded pin. In one embodiment, the feed arm assembly 114 slides over the knob 502 on the chamber holder 105 which rests against a top of the feed cover 504, thereby enabling the feed arm assembly 114 to pivot back and forth on the knob 502 while the knob 502 stays in place, and the feed arm assembly 114 to raise up and/or out of the way, and to grab the next link (See e.g., FIG. 5, Item 116) as the bolt carrier (See e.g., FIG. 3, Item 102) is cycling.

The illustrated feed cover 504 is disposed over the feed arm assembly 114. The feed cover 504 may be removably coupled to the weapon frame (See e.g., FIG. 3, Item 1011. In one embodiment, the feed cover 504 may be hinged to the weapon frame (See e.g., FIG. 3, Item 101). The feed cover 504 may be any size and/or shape for covering the feed arm assembly 114. The feed cover 504 covers and protects the feed arm assembly 114. In addition, the feed cover 504 includes a dimple 506 that mates with the point 503 of the knob 502. The dimple 506 may be any indentation or recess disposed along an underside of the feed cover 504. The dimple may have any depth, shape, and/or diameter.

In one embodiment, the illustrated chamber holder 105 has a knob 502 that extends therefrom. The feed arm assembly 114 slides over the knob 502 and is held in place by a point 503 disposed at a top of the knob 502, wherein the point 503 corresponds to the dimple 506. The point 503 engages with a dimple 506 disposed along, an underside of the feed cover 504. However, it is envisioned that the knob 502 may not have a point 503, and that the feed cover 504 may just rest directly on the knob 502.

Figure 7:
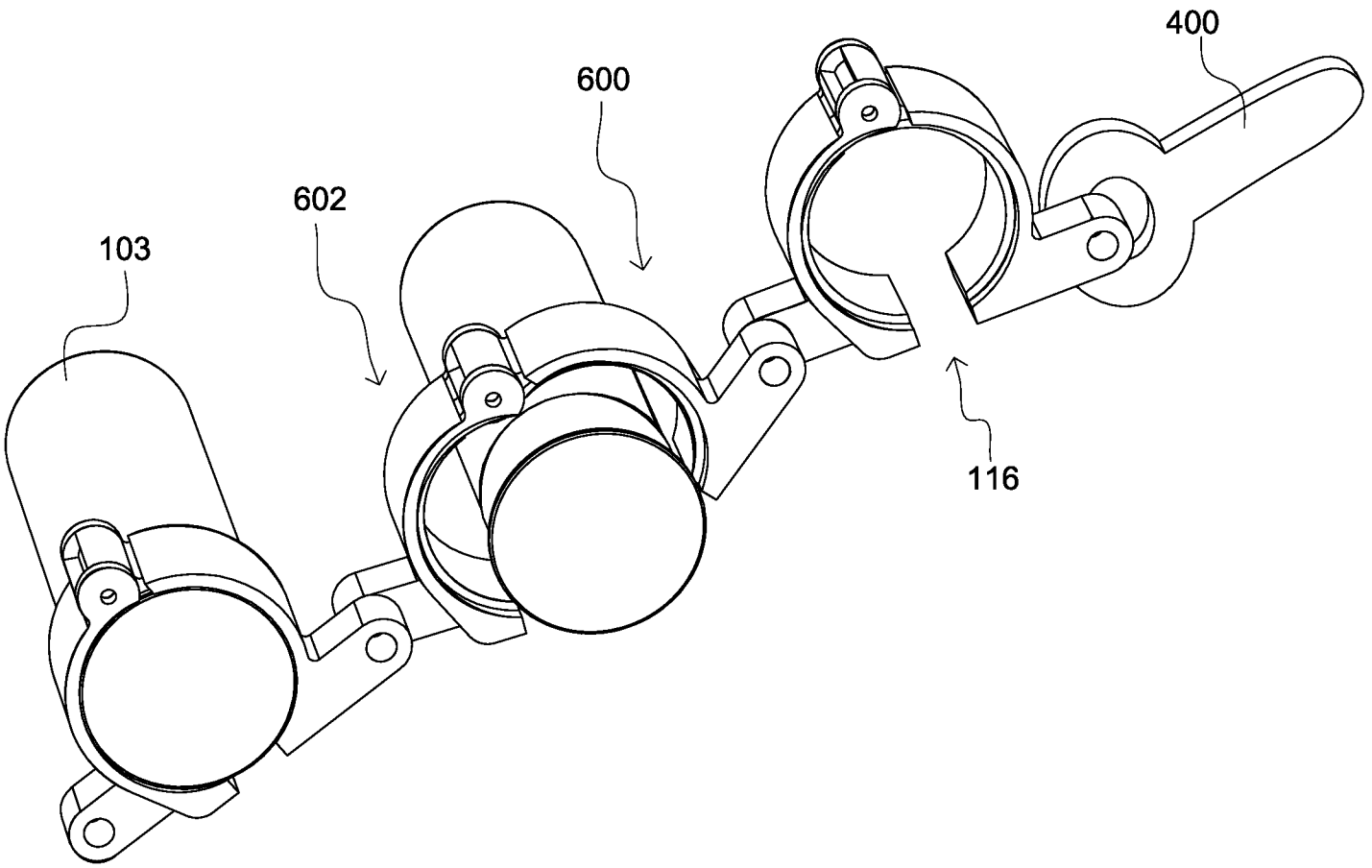
FIG. 7 is a rear perspective view of a plurality of links of a modular multi-caliber and/or gauge weapon system, according to one embodiment of the invention.

FIG. 7 is a rear perspective view of a plurality of links of a modular multi-caliber and/or gauge weapon system, according to one embodiment of the invention. There is illustrated a plurality of links 116. The links 116 have a right side 600 and able side 602. In one embodiment, the right side 600 may be removably coupled to the left side 602 for removably coupling to a cartridge and/or shot shell/shotgun shell 103. A link assist 400 is coupled to the plurality of links 116. The plurality of links 116 may have a link assist 400 coupled to a first link 116 and may be removably coupleable to the feed arm assembly (See e.g., FIG. 1, Item 114).

As shown, the links 116 are coupled together. In one non-limiting embodiment, the links 116 may be pivotally coupled together by a spring-loaded pin. In addition, the right side 500 may be coupled to the left side 602 by a pin and/or a quick threaded bolt. The pin may be spring-loaded. The links 116 may be pivotally coupled together for storing and releasing cartridges and/or shot shells/shotgun shells 103. In one embodiment, the links 116 may be non-disintegrating and reusable while still being able to be separated. In another embodiment, the links 116 may be reusable. The links 116 couple to a rearward portion of the cartridge and/or shot shell/shotgun shell 103 and the cartridges and/or shot shell/shotgun shell 101 may be uncoupled from the links 115 when the links are pivoted open. Accordingly, the links 115 may be manufactured to size according to specific cartridges and/or shot shell/shotgun shell 103. In addition, the links 116 may be coupled together and coupled to cartridges and/or shot shell/shotgun shell 103 to form an ammunition belt. Moreover, the links 116 may be stored in a box magazine and/or used free of a box magazine. Further, it is understood that the links 116 may have different dimensions based on the ammunition selected.

Figure 8:
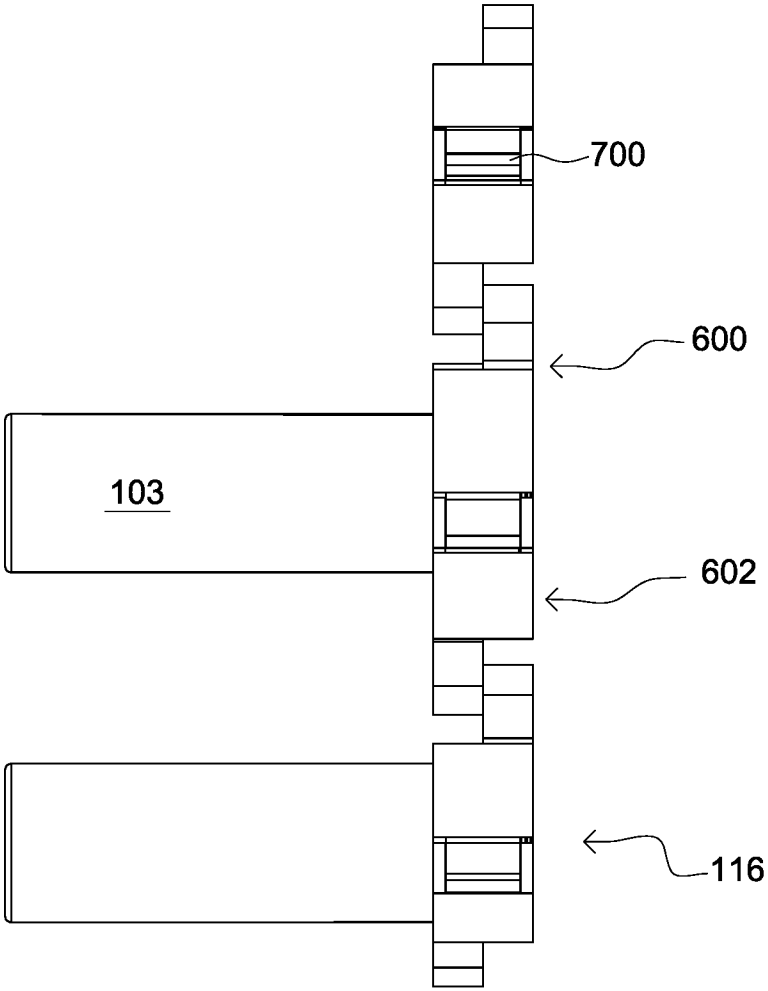
FIG. 8 is a top plan view of a plurality of links of a modular multi-caliber and/or gauge weapon system, according to one embodiment of the invention.

FIG. 8 is a top plan view of a plurality of links of a modular multi-caliber and/or gauge weapon system, according to one embodiment of the invention. There is shown a plurality of links 116. Each link has a right side 600 and a left side 602. In one embodiment, the links 116 may be removably coupled to a cartridge and; or shot shell/shotgun shell 103. Disposed between the right side 600 and the left side 602 is a groove 700. The groove 700 may be removably coupled to the grabbing protrusion of the feed arm assembly. (See e.g., FIG. 6, Items 500 and 114, respectively.)

As illustrated, the links 116 hinge in the middle so that each link has a left side 602 and a right side 600. According to the illustrations, a right-handed version is shown. It is envisioned that a left-handed version would be a mirror-image of the illustrated right-handed version. On a top of the right side 600 of each of the links 116 there is a groove 700. The groove 700 is a channel, depression, or divot that allows a feed arm assembly (See e.g., FIG. 6, Item 114) to fall into it and grab the links 116. The groove 700 may have any size and/or shape for coupling to the feed arm assembly (See e.g., FIG. 6, Item 114). In one embodiment, the feed arm assembly (See e.g., FIG. 6, Item 114) may be hinged so that it rises up over a rounded top part of a link 116 and drop down into the groove 700 in the link 116 so that the feed arm assembly (See e.g., FIG. 6, Item 114) can pull the link 116 through a firearm.

Figure 9:
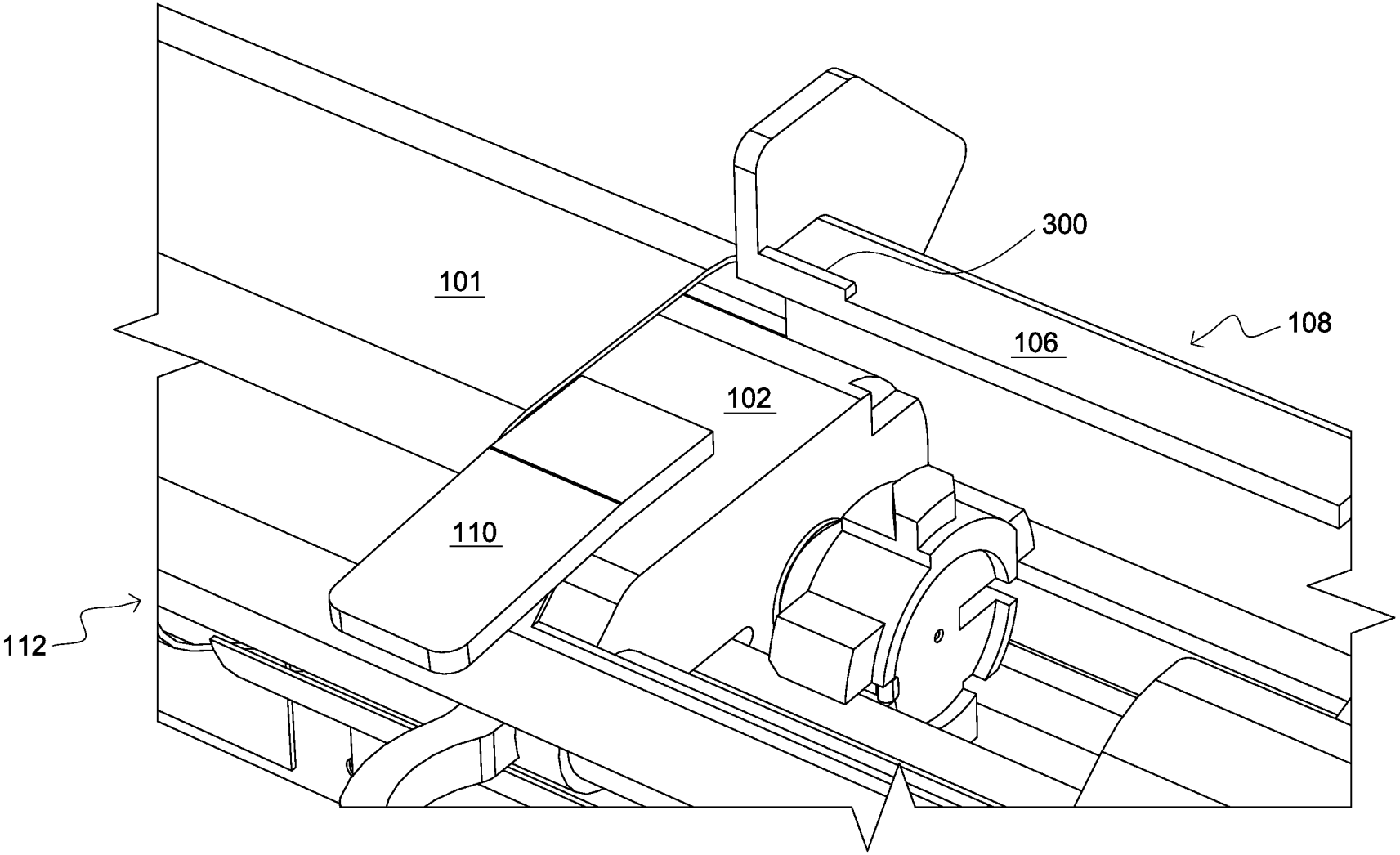
FIG. 9 is a partial second side perspective view of a modular multi-caliber and/or gauge weapon system with a feed cover removed showing a feed assembly with a protrusion disposed on an infeed ramp, according to one embodiment of the invention.

FIG. 9 is a partial second side perspective view of a modular multi-caliber and/or gauge weapon system with a feed cover removed showing a feed assembly with a protrusion, according to one embodiment of the invention. As illustrated, there is a weapon frame 101 with an infeed ramp 106 coupled to a first side 108 of the weapon frame 101, and an outfeed ramp 110 coupled to a second side 112 of the weapon frame 101 opposite, the infeed ramp 106. A bolt carrier 102 is disposed between the ramps 106 and 110. A protrusion 300 is disposed along the infeed ramp 106.

The illustrated protrusion 300 is disposed along a top portion of the infeed tamp 106. The protrusion 300 may be coupled to the infeed ramp 106 and extend upwardly and/or outwardly therefrom. The protrusion 300 may catch or grab a link (See e.g., FIG. 1, item 116) and thereby cause the link (See e.g., FIG. 1, Item 116) to pivot open as the link (See e.g., FIG. 1, Item 116) is pulled from the infeed ramp 106 to the outfeed ramp 110 by the feed arm assembly See e.g., FIG. 1, Item 114). The protrusion 300 may have any size and/or shape for catching and spreading links (See e.g., FIG. 1, Item 116). The protrusion 300 may be pyramid-shaped and/or oblong and/or a rectangular bar. The protrusion 300 may be an extension of the infeed ramp 106 and may be comprised of a variety of materials such as but not limited to metal and/or plastic.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the range and range of equivalency of the claims are to be embraced within their scope.

For example, the feed assembly and links may have a variety of shapes and sizes configured to load a cartridge and/or shot shell/shotgun shell and be reusable in the field. There may be feed arm assemblies of different sizes and angles to allow one to use different sized cartridges and/or shot shells/shotgun shells and/or different feed arm assemblies of different sizes and angles to allow one to use single piece construction belts and/or disintegrating links that form an ammunition belt of different sized cartridges and/or shot shells/shotgun shells. It is further envisioned that the feed arm and/or feed arm assembly and/or the grabbing portion and/or parts that make tip the feed arm assembly may be manufactured based on the size of the cartridge and/or shot shell/shotgun shell. Similarly, the links may be manufactured to fit various headstamp and/or cartridge and/or shot shells/shotgun shell diameters/sizes. Moreover, it is understood that the belt fed weapon may use, but is not limited to plastic cased ammunition, careless ammunition, telescoping ammunition, as well as conventional styles of ammunition.

It is also expected that there could be numerous variations of the design of this invention. An example is that the feed arm and/or feed arm assembly may be attached to a sleeve that goes over the knob of the chamber holder, and the feed arm and/or feed arm assembly may be hinged. More, the chamber holder may include a feed arm assembly knob that is a shaft extending substantially above the chamber holder. The sleeve may slide over the chamber holder knob and rotate on it.

Additionally, the ramps may be integral, and fixedly coupled, to the weapon frame. Also, the link assist may be a one-size-fits-all and may be configured to attach to any link with (but not limited to) a pin (such as a spring-loaded pin), as long as it is long, enough to provide a handle and is able to clear the infeed and outfeed ramps. Furthermore, it is envisioned that a portion of the link feed assembly may hold ammunition in place after it has been stripped from the links, but before it has to be chambered. This portion may be a part of the feed arm assembly and/or a portion of the box magazine and/or a magazine well insert, it may be different from a trough on top of a box magazine or a trough on top of a part that looks like the top portion of the box magazine that inserts into the magazine well that does not hold ammunition but just inserts into a magazine well when the links are being used independent of a box magazine to cradle ammunition that has been stripped from the links. It is also understood that where the illustrations show right-hand versions, it understood that left-hand versions would be a mirror-image of the right-hand versions.

Finally, it is envisioned that the components of the device may be constructed of a variety of materials, such as aluminum, steel, plastic, and so on.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A link feed assembly for supplying cartridges and/or shot shells and/or shotgun shells to a weapon system, comprising:

a. a bolt carrier near a chamber of a weapon system;

b. an infeed ramp, coupled to a first side of a weapon frame near the chamber;

c. an outfeed ramp, coupled to a second side of the weapon frame near the chamber and opposite the infeed ramp, positioned to form a space between the infeed ramp and the outfeed ramp through which cartridges may fall into position to be chambered into firing position in the chamber, wherein the infeed ramp and the outfeed ramp are discrete structures fixedly coupled to opposite sides of the weapon frame; and d. a feed arm assembly coupled to the weapon frame and extending over the space between the infeed ramp and the outfeed ramp, the feed arm assembly functionally coupled to the bolt carrier such that cycling of the bolt carrier forward and backwards causes cycling of the feed arm assembly in a circuitous motion, the feed arm assembly including a grabbing protrusion that is shaped to grab a top portion of a link during cycling of the feed arm assembly and drag the link across the space between the infeed ramp and the outfeed ramp and then rise upwards and travel back across the space.

2. The link feed assembly of claim 1, further comprising a plurality of links, wherein each link is slidably coupled to the infeed ramp and the outfeed ramp.

3. The link feed assembly of claim 1, further comprising a chamber holder disposed about the chamber, wherein the feed arm assembly is removably coupled to the chamber holder.

4. The link feed assembly of claim 3, wherein the infeed ramp includes a protrusion coupled to the infeed ramp and extending outwardly therefrom, and removably and slidably coupled to the links.

5. The link feed assembly of claim 4, wherein the protrusion is pyramid-shaped.

6. The link feed assembly of claim 2, wherein the plurality of links are non-disintegrating and reusable in the field without the need of tools.

7. The link feed assembly of claim 3, wherein the feed arm assembly is coupled to the chamber holder by a pin.

8. The link feed assembly of claim 2, wherein each link of the plurality of links is pivotally coupled to another link by a spring-loaded pin; and wherein each link has a right side and a left side with a groove disposed along a top of the right side of each link, the groove removably coupled to a grabbing protrusion of the feed arm assembly.

9. The link feed assembly of claim 8, wherein a first link of the plurality of links includes a link assist that is coupled to the first link, wherein the link assist is tongue-shaped.

10. The link feed assembly of claim 1, wherein the infeed ramp includes a ridge disposed along a top portion of the ramp which may be disposed beneath a cartridge preparing to be chambered.

11. The link feed assembly of claim 3, further comprising a knob disposed along a top of the chamber holder, and a feed cover disposed over the feed arm assembly, wherein the feed cover includes a dimple that mates with the knob.

12. A semi-automatic and/or automatic fire weapon system, comprising:

a. a bolt carrier near a chamber of a weapon system;

b. an infeed ramp, fixedly coupled directly to a first side of a weapon frame near the chamber and extending therefrom;

c. an outfeed ramp, fixedly coupled directly to a second side of the weapon frame near the chamber and opposite the infeed ramp and extending therefrom, positioned to form a space between the infeed ramp and the outfeed ramp through which cartridges may fall into position to be chambered into firing position in the chamber;

d. a feed arm assembly coupled to the weapon frame and extending over the space between the infeed ramp and the outfeed ramp, the feed arm assembly functionally coupled to the bolt carrier such that cycling of the bolt carrier forward and backwards causes cycling of the feed arm assembly in a circuitous motion, the feed arm assembly including a grabbing protrusion that is shaped to grab a top portion of a link during cycling of the feed arm assembly and drag the link across the space between the infeed ramp and the outfeed ramp and then rise upwards and travel back across the space; and e. a chamber holder disposed about the chamber, wherein the feed arm assembly is removably coupled to the chamber holder.

13. The link feed assembly of claim 12, further comprising a plurality of links, wherein each link is releasably coupled to the infeed ramp and the outfeed ramp.

14. The link feed assembly of claim 13, wherein the infeed ramp includes a protrusion coupled to the infeed ramp and extending outwardly therefrom, and removably and slidably coupled to the links.

15. The link feed assembly of claim 14, wherein the protrusion is pyramid-shaped.

16. The link feed assembly of claim 15, wherein each link of the plurality of links is pivotally coupled to another link; and wherein each link has a right side and a left side with a groove disposed along a top of the right side of each link, the groove removably coupled to a tab of the feed arm assembly.

17. The link feed assembly of claim 16, wherein a first link of the plurality of links includes a link assist that is removably coupled to the first link, wherein the link assist is tongue-shaped.

18. The link feed assembly of claim 17, wherein the infeed ramp includes a ridge disposed along a top portion of the ramp which may be disposed beneath a cartridge preparing to be chambered.

19. The link feed assembly of claim 18, further comprising a knob disposed along a top of the chamber holder, and a feed cover disposed over the feed arm assembly, wherein the feed cover includes a dimple that mates with a point disposed on the knob.

20. A link feed assembly for supplying cartridges and/or shot shells and/or shotgun shells to a weapon system, comprising:

a. a bolt carrier near a chamber of a weapon system;

b. an infeed ramp, coupled to a first side of a weapon frame near the chamber, wherein the infeed ramp includes a ridge disposed along a top portion of the ramp which may be disposed beneath a cartridge preparing to be chambered;

c. an outfeed ramp, coupled to a second side of the weapon frame near the chamber and opposite the infeed ramp, positioned to form a space between the infeed ramp and the outfeed ramp through which cartridges may fall into position to be chambered into firing position in the chamber;

d. a feed arm assembly coupled to the weapon frame and extending over the space between the infeed ramp and the outfeed ramp, the feed arm assembly functionally coupled to the bolt carrier such that cycling of the bolt carrier forward and backwards causes cycling of the feed arm assembly in a circuitous motion, the feed arm assembly including a grabbing protrusion that is shaped to grab a top portion of a link during cycling of the feed arm assembly and drag the link across the space between the infeed ramp and the outfeed ramp and then rise upwards and travel back across the space;

e. a plurality of non-disintegrating and reusable links, wherein each link is releasably coupled to the infeed ramp and the outfeed ramp, wherein the infeed ramp includes a pyramid-shaped protrusion coupled to the infeed ramp and extending outwardly therefrom, and removably and slidably coupled to the links, wherein each link is pivotally coupled to another link; and wherein each link has a right side and a let side with a groove disposed along a top of the right side of each link, the groove removably coupled to a grabbing protrusion of the feed arm assembly, wherein a first link includes a link assist that is removably coupled to the first link, wherein the link assist is tongue-shaped;

f. a chamber holder disposed about the chamber and wherein the feed arm assembly is removably and coupled to the chamber holder; and g. a knob disposed along a top of the chamber holder, and a feed cover disposed over the feed arm assembly, wherein the feed cover includes a dimple that mates with a point disposed on the knob.

* * * * *